US005967299A

United States Patent [19]

de Richecour et al.

[11] Patent Number: 5,967,299

[45] Date of Patent: Oct. 19, 1999

[54] MEMBRANE SWITCH

[75] Inventors: Louis Emmanuel Dagneau de Richecour, Fromentiers; Alfred Bientz, Chateau Gontier, both of France

[73] Assignee: Molex Incorporated, Lisle, Ill.

[21] Appl. No.: 09/041,442

[22] Filed: Mar. 12, 1998

[51] Int. Cl.[6] ..... H01H 1/10

[52] U.S. Cl. ..... 200/512; 29/622

[58] Field of Search ..... 29/622; 200/5 A, 200/511–517

[56] References Cited

U.S. PATENT DOCUMENTS

| | | | |
|---|---|---|---|
| 3,323,197 | 6/1967 | Millard | 29/155.5 |
| 3,718,791 | 2/1973 | Szablowski | 200/85 A |
| 4,043,858 | 8/1977 | Dantowitz | 156/251 |
| 4,264,797 | 4/1981 | Parkinson | 200/159 B |
| 4,324,962 | 4/1982 | Dulen | 200/159 B |
| 4,332,082 | 6/1982 | Johnson | 29/622 |
| 4,338,502 | 7/1982 | Hashimoto et al. | 200/159 B |
| 4,345,119 | 8/1982 | Latasiewicz | 200/5 A |
| 4,356,366 | 10/1982 | Harper et al. | 200/159 B |
| 4,360,716 | 11/1982 | Fiorella | 200/5 A |
| 4,415,780 | 11/1983 | Daugherty et al. | 200/5 A |
| 4,499,662 | 2/1985 | Takeuchi | 29/622 |
| 4,551,595 | 11/1985 | Koenig et al. | 200/86 R |
| 4,639,559 | 1/1987 | Taguchi | 200/5 A |
| 5,062,198 | 11/1991 | Sun | 29/622 |
| 5,072,077 | 12/1991 | Klein | 200/5 A |
| 5,228,562 | 7/1993 | Burk | 200/512 |
| 5,286,937 | 2/1994 | Santo et al. | 200/516 |
| 5,399,819 | 3/1995 | Lang et al. | 200/61.54 |
| 5,554,835 | 9/1996 | Newham | 200/85 R |

FOREIGN PATENT DOCUMENTS

| | | | |
|---|---|---|---|
| 0 669 229 A2 | 2/1994 | European Pat. Off. | B60R 21/20 |
| 53-23944 | 2/1974 | Japan | H01H 11/00 |
| 3-119621 | 9/1989 | Japan | H01H 13/52 |
| 4-126319 | 9/1990 | Japan | H01H 13/52 |

*Primary Examiner*—Michael A. Friedhofer
*Attorney, Agent, or Firm*—James C. Paschall

[57] ABSTRACT

A method of fabricating a membrane switch, an article of manufacture and the membrane switch, itself, are disclosed. The membrane switch is of the type including a pair of insulating layers each having at least one contact area formed thereon in facing relation the contact area of the other layer. A protective layer is disposed between the insulating layers at least in the vicinity of the facing contact areas to maintain the contact areas separated during a subsequent fabrication step involving the application of heat and/or pressure. The protective layer is removed after the fabrication step is performed.

17 Claims, 3 Drawing Sheets

MEMBRANE SWITCH

FIELD OF THE INVENTION

This invention generally relates to the art of electrical switches and, particularly, to a membrane switch.

BACKGROUND OF THE INVENTION

Membrane switches have become popular for use in industrial controls, home appliances, office equipment and automotive applications. Membrane switches are touch activated and have some advantages over electrical switches. For instance, mechanical switches are prone to mechanical failure due to breakage of moving parts. This problem is not prevalent with membrane switches. In addition, membrane switches conserve considerable space over conventional mechanical switches due to their very thin profile.

A typical membrane switch includes a lower insulating layer, a dielectric spacer layer and an upper insulating layer. Typically, one of the insulating layers is fixed and the other insulating layer is movable, with the spacer layer separating the two insulating layers. One or more electrically conductive contact areas are provided on the upper face of the lower insulating layer and the lower face of the upper insulating layer in facing relation to define the contacts of the switch. Most often, a plurality of pairs of the facing contact areas are provided between the juxtaposed insulating layers, and the spacer layer has a plurality of openings through which the contact areas of each pair thereof are exposed to each other in facing relation.

To make connection with a device to be switched, the facing contact areas are extended to the periphery of their respective insulating layers and are connected to external leads which, in turn, are connected to the particular device to be switched. In use, movement of the insulating layers toward each other, such as moving the movable insulating layer toward the fixed insulating layer, causes a given pair of the facing contact areas to engage and close a circuit through the external leads connected to the device to be switched.

While membrane switches have been fairly easy and efficient to fabricate, incorporating the switches into various apparatus has caused problems, particularly when the fabrication involves the application of heat and/or pressure. The insulating layers which carry the facing contact areas of the membrane switch typically are fabricated of some type of plastic material, such as polyester. When these layers are subjected to heat and/or pressure, they can collapse, even when spacer layers are used in the switch. Collapsing of the insulating layers causes the distance between the facing contact areas to vary and can even cause the contact areas to touch and cause permanent electrical contact.

One example of the manifestation of the problem discussed above is switches mounted in a steering wheel for a vehicle horn in the automotive industry. To facilitate access to the actuator for the horn switch, the actuator is preferably disposed in the central surface of the steering wheel. The advent of the air-bag has made it common to locate an air-bag assembly in the center of the steering wheel thereby complicating the task of mounting switches in steering wheels. The air-bag assembly is relatively bulky, comprising a compacted air-bag and a gas generator. In order to locate the horn switch assembly with the actuator disposed in the central surface of the steering wheel, mechanical horn switches have been incorporated into the air bag assembly. Such mechanical horn switches are attended by complexities of increased weight and volume. As an alternative, horn switches are sometimes placed beside the air-bag assembly, with the actuator for the horn switch located outside the central surface of the steering wheel. Actuators for such switches are often difficult to access in sudden situations.

The use of a membrane switch in a steering wheel for actuating the vehicle horn would solve the problems posed by mechanical switches, described above. The membrane switch could provide a significantly larger area of actuation, and the membrane switch would present considerably fewer volume and mass problems than the mechanical switches. However, the use of a membrane switch poses its own problems because of the application of heat and pressure during manufacture of the steering wheel assembly, such as during overmolding processes.

The present invention is directed to solving the above myriad of problems by providing a method of fabricating a membrane switch, an article of manufacture and the switch, itself, wherein the components of the switch are protected from collapsing during manufacture, such as during processes involving the application of heat and/or pressure.

SUMMARY OF THE INVENTION

An object, therefore, of the invention is to provide a new and improved method of fabricating a membrane switch.

Another object of the invention is to provide a new and improved article of manufacture in the fabrication of a membrane switch.

A further object of the invention is to provide a new and improved membrane switch of the character described.

In the exemplary embodiment of the invention, the membrane switch is of the type including a pair of insulating layers each having at least one contact area formed thereon in facing relation with the contact area of the other layer. The method of fabrication includes the steps of juxtaposing the pair of insulating layers with the contact areas thereon in facing relation. A protective layer is inserted between the insulating layers at least in the vicinity of the facing contact areas to maintain the contact areas separated during a subsequent fabrication step involving the application of heat and/or pressure. The protective layer then is removed after the fabrication step is performed.

As disclosed herein, the insulating layers are joined about a substantial peripheral portion surrounding the facing contact areas, leaving a peripheral access opening to the contact areas. The protective layer is removed by pulling the protective layer out through the access opening.

The method may include the step of positioning a spacer layer between the pair of insulating layers except between the facing contact areas. As disclosed herein, the spacer layer surrounds a substantial portion of the facing contact areas except for the peripheral access opening through which the protective layer is pulled out from between the insulating layers.

The invention also contemplates an article of manufacture in the fabrication of the membrane switch. The article includes the pair of juxtaposed insulating layers with the facing contact areas thereon, and with the protective layer removably mounted between the insulating layers at least in the vicinity of the facing contact areas. This article of manufacture then can be shipped to an ultimate fabricator, such as an automotive manufacturer, where the article of manufacture can be incorporated in an appropriate apparatus, such as a vehicle steering wheel.

The invention further contemplates a membrane switch which includes a pair of juxtaposed insulating layers each having at least one conductive contact area thereon in facing relation with the contact area of the other layer. The insulating layers are joined about a substantial peripheral portion surrounding the facing contact areas, leaving a peripheral opening between the layers communicating with the facing contact areas. The insulating layers are elongated to define two major sides and at least one minor side, with the peripheral opening being in the minor side. A generally U-shaped spacer layer is disposed between the pair of insulating layers except between the facing contact areas, with an open end of the U-shaped spacer layer being coincident with the peripheral opening between the insulating layers. The facing contact areas are elongated and extend between the two major sides of the elongated insulating layers.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
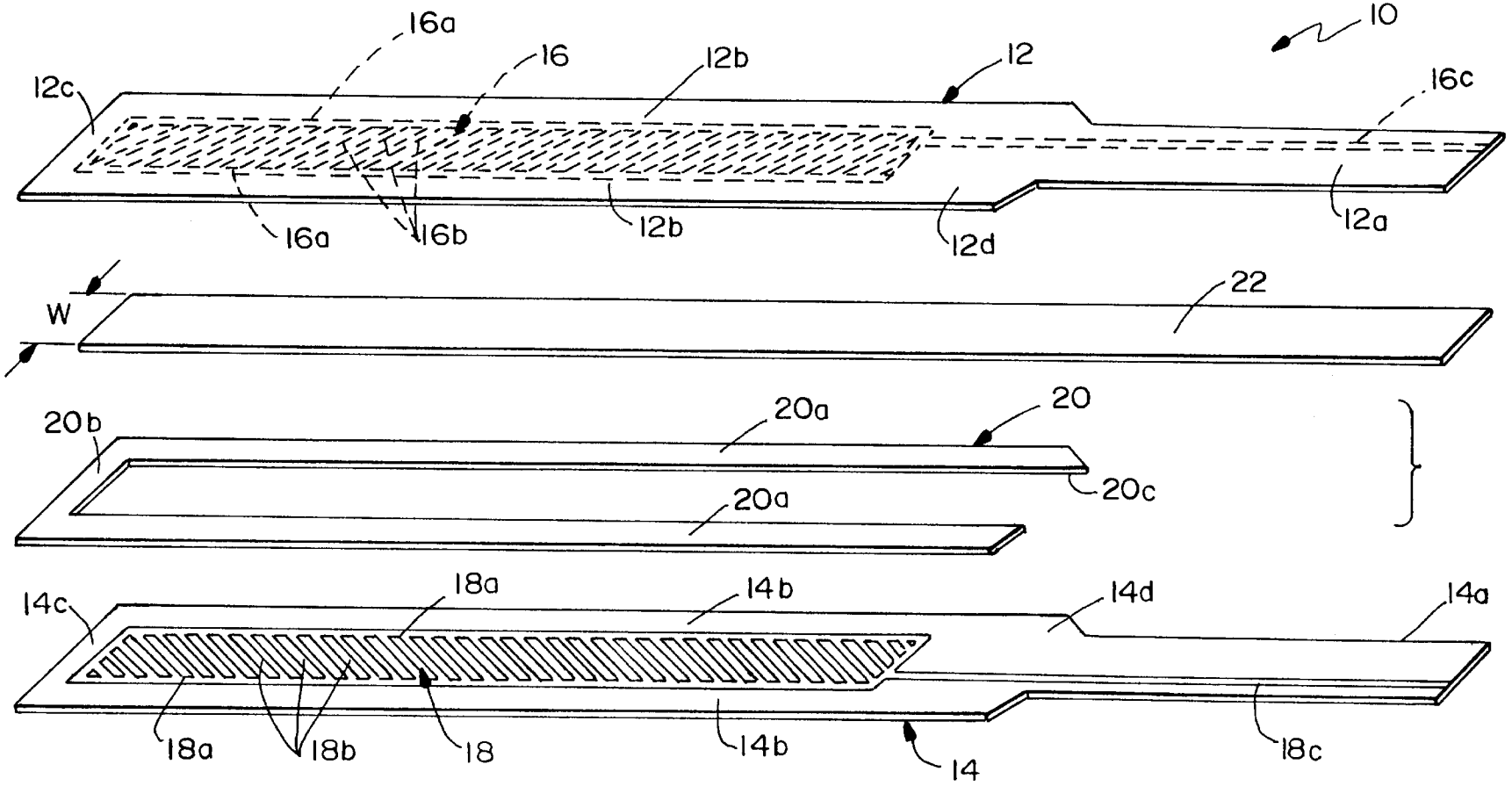
FIG. 1 is an exploded perspective view of the components of a membrane switch incorporating the concepts of the invention.
Figure 2:
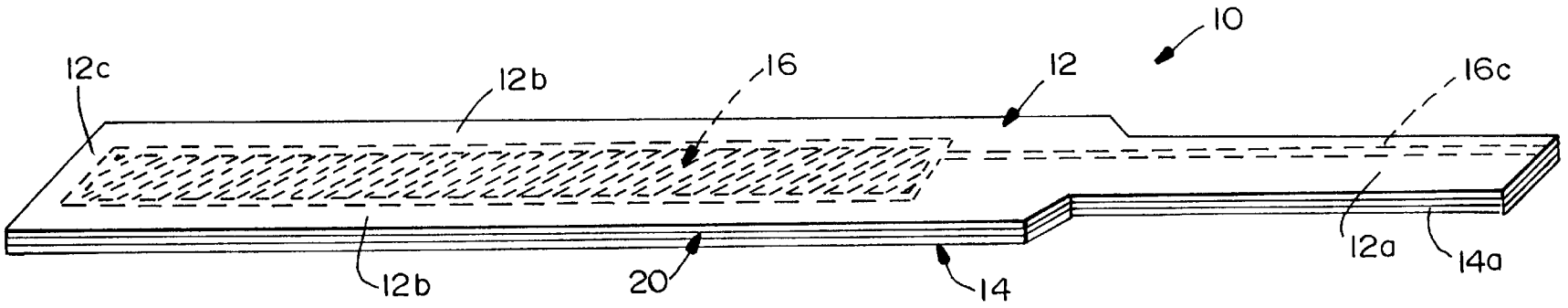
FIG. 2 is a perspective view of the membrane switch in assembled condition.
Figure 3:
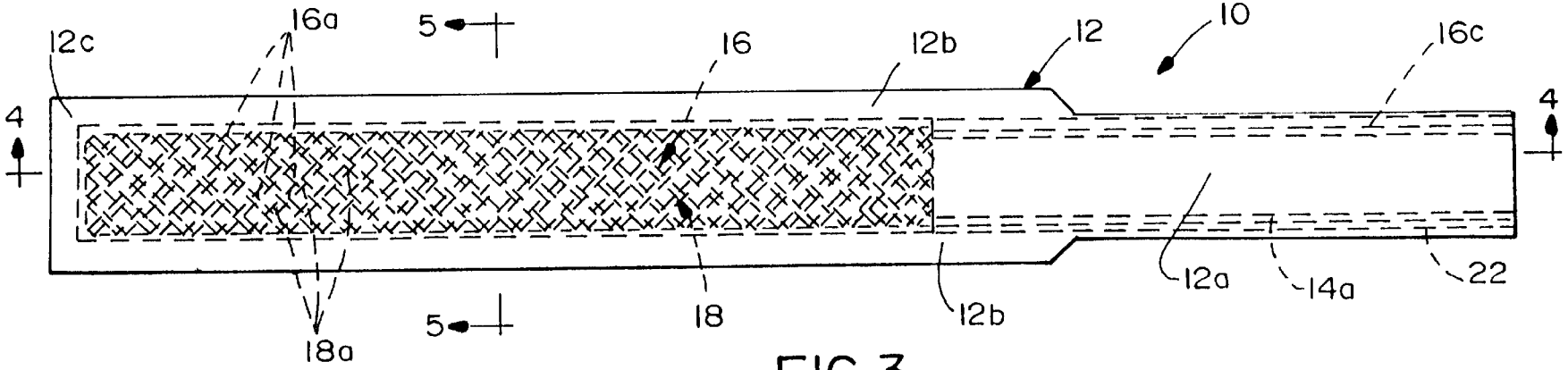
FIG. 3 is a top plan view of the membrane switch.

The invention herein is incorporated in a membrane switch, generally of the type including a pair of insulating layers each having at least one contact area formed thereon in facing relation with the contact area of the other layer. In particular, FIGS. 1–3 show a membrane switch, generally designated 10, which includes an upper insulating layer, generally designated 12, and a lower insulating layer, generally designated 14. The layers are narrow and elongated and include end tab portions 12*a* and 14*a*. Being elongated, upper insulating layer 12 defines a pair of opposite major sides 12*b* and opposite minor sides 12*c* and 12*d*. Similarly, lower insulating layer 14 being elongated defines a pair of opposite major sides 14*b* and opposite minor sides 14*c* and 14*d*. The upper insulating layer 12 and the lower insulating layer 14 should be made from an insulative, high-temperature material which will not melt when subjected to overmolding temperatures. For high temperature applications, such as overmolding that would be around 250° C., a polyimide such as KAPTON from E.I. du Pont de Nemours & Co., is the preferred material. Other materials such as polyetherimides, polyetherketones, polyethersulfones, polyethylene naphtaltes and meta-aramides may also be suitable depending on the highest temperature reached during the overmolding process.

Upper elongated insulating layer 12 has an elongated, centrally disposed contact area, generally designated 16, on the bottom surface thereof, and lower elongated insulating layer 14 has an elongated, centrally disposed contact area, generally designated 18. The contact areas are imprinted or otherwise adhered to the bottom surface of upper insulating layer 12 and the top surface of lower insulating layer 14. Inks or adhesives used to constitute the contact areas 16, 18 should each be made from a suitable high-temperature material that will not melt or become sticky when subjected to overmolding temperatures. Silver ink is preferred for high conductivity. However, carbon/graphite ink or silver/carbon ink may be suitable, as long as it will not become sticky when exposed to heat and/or pressure. The preferred high temperature adhesives are acrylic pressure sensitive adhesives, such as No. 966 from Minnesota Mining and Manufacturing Company, but other thermoplastic adhesives may be suitable.

Contact area 16 has a rectangular peripheral conductive band 16*a* joined by diagonal conductive bands 16*b*, and contact area 18 has a rectangular peripheral conductive band 18*a* joined by a plurality of diagonal conductive bands 18*b*. Diagonal conductive bands 16*b* define a crisscross pattern with diagonal conductive bands 18*b* lengthwise of the contact areas 16 and 18, so that the contact areas will mutually engage when moved toward each other at any point lengthwise of the pattern of conductive bands. Contact area 16 is extended into end tab portion 12*a* of upper insulating layer 12 by a conductive band extension 16*c*, and contact area 18 is extended into end tab portion 14*a* of lower insulating layer 14 by a conductive band extension 18*c*. Band extensions 16*c* and 18*c* are connectible to appropriate conductive leads to a device which is to be switched.

An elongated spacer layer, generally designated 20, may be used between insulating layers 12 and 14 except between the elongated facing contact areas 16 and 18. Spacer layer 20 is generally U-shaped to define a pair of leg portions 20*a* joined at one end by a bight portion 20*b*, with an opposite end open, as at 20*c*. The spacer layer is sandwiched between upper insulating layer 12 and lower insulating layer 14. When properly positioned, leg portions 20*a* of the spacer layer are sandwiched between major sides 12*b* and 14*b* of insulating layers 12 and 14, respectively. Bight portion 20*b* of the insulating layer is sandwiched between minor sides 12*c* and 14*c* of the insulating layers 12 and 14, respectively. Contact areas 16 and 18, thereby, are exposed facing each other between leg portions 20*a* of the elongated spacer layer. Open end 20*c* of the spacer layer cooperates with upper and lower insulating layers 12 and 14, respectively, to define an access opening to the space between contact areas 16 and 18. The access opening is in line with end tab portions 12*a* and 14*a* of insulating layers 12 and 14, respectively. The space layer 20, like the insulating layers 12, 14, should be made from an insulative, high-temperature material that will not melt when subjected to overmolding temperatures. For high temperature applications, such as overmolding that would be around 250° C., a polyimide, such as KAPTON from E.I. du Pont de Nemours & Co. is the preferred material. Other materials such as polyetherimides, polyetherketones, polyethersulfones, polyethylene naphtaltes and meta-aramides may also be suitable depending on the highest temperature reached during the overmolding process.

Generally, the invention contemplates the use of a protective layer 22 removably mounted between insulating layers 12 and 14 at least in the vicinity of facing contact areas 16 and 18 to maintain the contact areas separated for manufacturing purposes. Protective layer 22 is removable from between insulating layers 12 and 14 to enable the switch for use. As stated in the "Background", above, when membrane switches are used in applications involving the application of heat and/or pressure, plastic insulating layers, such as layers 12 and 14, have a tendency to collapse in the spacing between the facing contact areas. This can cause the membrane switch to undesirably provide permanent contact. Protective layer 22 is effective to prevent any such collapsing, and the protective layer is readily removable for ultimate use of the switch.

More particularly, protective layer 22 has a width "W" which is slightly less than the distance between leg portions 20*a* of spacer layer 20 which, in turn, is substantially equal to the width of contact areas 16 and 18. The protective layer has a length such that the protective layer can be fully inserted to bight portion 21*b* of spacer layer 20 and minor sides 12*c* and 14*c* of insulating layers 12 and 14, respectively, and with the protective layer extending outwardly between end tab portions 12*a* and 14*a* of the insulating layers. The protective layer is readily inserted and removed from the surrounding insulating layers and spacer layer through open end 20*c* of the spacer layer.

The protective layer 22 should also be made from a high-temperature material that will not melt when subjected to overmolding temperatures and will not adhere to the insulating layers 12, 14 or the contact areas 16, 18. The protective layer 22 is preferably made from polytetrafluoroethylene.

In fabrication, insulating layers 12 and 14 are joined or adhered with a high-temperature adhesive to spacer layer 20 at major sides 12*b* and 14*b* of the insulating layers and leg portions 20*a* of the spacer layer, as well as at minor sides 12*c* and 14*c* of the insulating layers and bight portion 20*b* of the spacer layer. That leaves an access opening at open end 20*c* of the spacer layer between the insulating layers for the insertion and removal of protective layer 22. Actually, during fabrication, the protective layer could be placed in position within the assembly prior to laminating the insulating layers and spacer layer, or the protective layer can be inserted after the insulating layers and spacer layer are joined.

Figure 4:
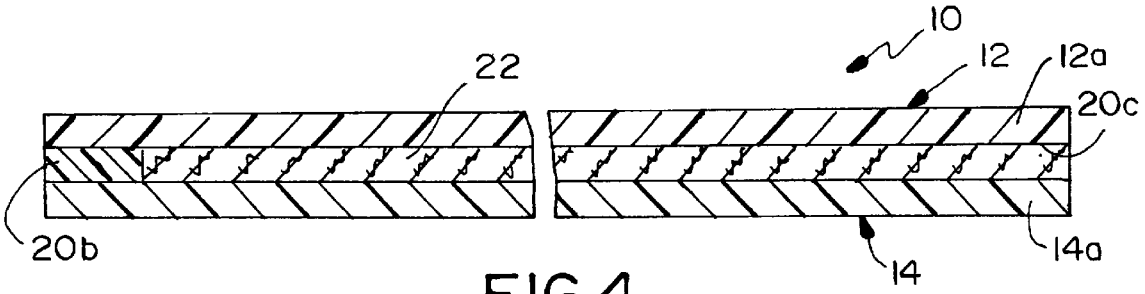
FIG. 4 is a fragmented vertical section taken generally along line 4—4 of FIG. 3.
Figure 5:
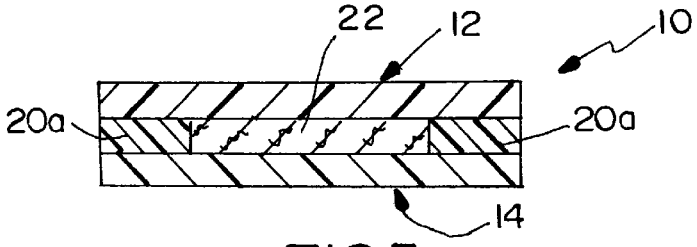
FIG. 5 is a vertical section taken generally along line 5—5 of FIG. 3.
Figure 6:
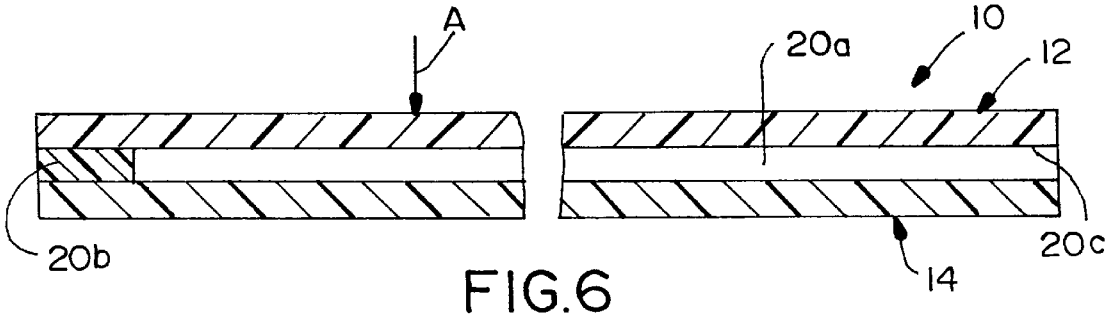
FIG. 6 is a view similar to that of FIG. 4, with the protective layer removed.
Figure 7:
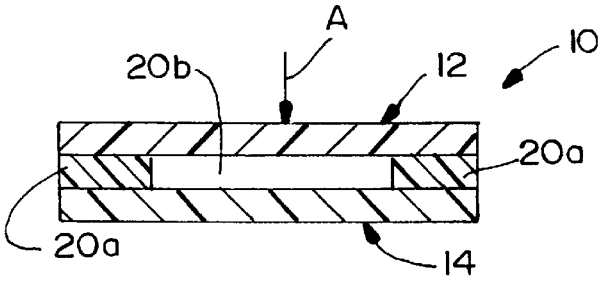
FIG. 7 is a view similar to that of FIG. 5, with the protective layer removed.

FIGS. 4 and 5 show protective layer 22 located between upper and lower insulating layers 12 and 14, respectively, and within leg portions 20*a* and bight portion 20*b* of spacer layer 20. In this position, the protective layer is sandwiched between contact areas 16 and 18. This article of manufacture then can be shipped to an ultimate manufacturer whereat the article or assembly can be incorporated in an apparatus involving the application of heat and/or pressure. After the subsequent fabrication step is performed, protective layer 22 can be pulled out of the assembly through the access opening at open end 20*c* (FIG. 1) of the spacer layer, leaving an open space between upper and lower insulating layers 12 and 14, respectively in the vicinity of the facing contact areas 16 and 18. The removal of the protective layer is shown in FIGS. 6 and 7. With the protective layer removed, a membrane switch is provided whereby touch pressure can be applied in the direction of arrow "A" (FIGS. 6 and 7) to relatively move the insulating layers toward each other and cause contact areas 16 and 18 to engage and close a circuit therethrough leading away from the membrane switch through conductive band extensions 16*c* and 18*c* of the contact areas.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A method of fabricating a membrane switch including a pair of insulating layers each having at least one contact area formed thereon in facing relation with the contact area of the other layer, comprising the steps of:

juxtaposing said pair of insulating layers with the contact areas thereon in facing relation;

inserting a protective layer between said insulating layers at least in a vicinity of said facing contact areas to maintain the contact areas separated during a subsequent fabrication step involving an increased temperature; and removing said protective layer after said fabrication step is performed.

2. The method of claim 1 wherein said insulating layers are joined about a substantial peripheral portion surrounding the facing contact areas leaving a peripheral access opening to the contact areas, and said protective layer is removed by pulling the protective layer out through the access opening.

3. The method of claim 1, wherein the step of juxtaposing said pair of insulating layers with the contact areas thereon in facing relation further includes the step of positioning a spacer layer between said pair of insulating layers except between the facing contact areas.

4. The method of claim 3 wherein said spacer layer surrounds a substantial portion of the facing contact areas except for a peripheral access opening to the contact areas, and said protective layer is removed by pulling the protective layer out through the access opening.

5. An article of manufacture in a fabrication of a membrane switch, comprising:

a pair of juxtaposed insulating layers each having at least one conductive contact area thereon in facing relation with the contact area of the other layer; and a protective layer removably mounted between the insulating layers at least in a vicinity of the facing contact areas to maintain the contact areas separated, the protective layer being removable from between the insulating layers to enable the switch for use.

6. The article of claim 5 wherein said insulating layers are joined about a substantial peripheral portion surrounding the facing contact areas leaving a peripheral access opening through which the protective layer can be removed.

7. The article of claim 6, including a spacer layer between said pair of insulating layers except between the facing contact areas and said peripheral access opening.

8. The article of claim 6 wherein said insulating layers are elongated to define two major sides and at least one minor side, with said peripheral access opening being in the minor side.

9. The article of claim 8, including a spacer layer between said pair of insulating layers except between the facing contact areas and said peripheral access opening.

10. The article of claim 9 wherein said spacer layer is generally U-shaped with an open end coincident with said peripheral access opening.

11. The article of claim 8 wherein said facing contact areas are elongated and extend between said two major sides of the elongated insulating layers.

12. A membrane switch, comprising a pair of juxtaposed insulating layers each having at least one conductive contact area thereon in facing relation with the contact area of the other layer, and the insulating layers being joined about a substantial peripheral portion surrounding the facing contact areas leaving a peripheral opening between the layers communicating with the facing contact areas, said peripheral portion including a first side and a second side opposed to each other and said peripheral opening substantially comprises the entire second side.

13. The membrane switch of claim 12, including a spacer layer between said pair of insulating layers except between the facing contact areas and said peripheral opening.

14. The membrane switch of claim 12 wherein said insulating layers are elongated to define two major sides and at least one minor side, with said peripheral opening being in the minor side.

15. The membrane switch of claim 14, including a spacer layer between said pair of insulating layers except between the facing contact areas and said peripheral opening.

16. The membrane switch of claim 15 wherein said spacer layer is generally U-shaped with an open end coincident with said peripheral access opening.

17. The membrane switch of claim 14 wherein said facing contact areas are elongated and extend between said two major sides of the elongated insulating layers.

* * * * *